US009899201B1

(12) United States Patent
Park

(10) Patent No.: US 9,899,201 B1
(45) Date of Patent: Feb. 20, 2018

(54) HIGH DYNAMIC RANGE ION DETECTOR FOR MASS SPECTROMETERS

(71) Applicant: Bruker Daltonics, Inc., Billerica, MA (US)

(72) Inventor: Melvin Andrew Park, Billerica, MA (US)

( * ) Notice: Subject to any disclaimer, the term of this patent is extended or adjusted under 35 U.S.C. 154(b) by 0 days.

(21) Appl. No.: 15/346,977

(22) Filed: Nov. 9, 2016

(51) Int. Cl.

| | |
|---|---|
| ***H01J 49/40*** | (2006.01) |
| ***H01J 49/06*** | (2006.01) |
| ***H01J 49/08*** | (2006.01) |
| ***H01J 49/02*** | (2006.01) |

(52) U.S. Cl.
CPC ..... *H01J 49/08* (2013.01); *H01J 49/025* (2013.01); *H01J 49/40* (2013.01)

(58) Field of Classification Search
CPC ..... H01J 49/025; H01J 49/40; H01J 49/0036; H01J 49/027; H01J 49/0009; H01J 49/0022; H01J 49/06; H01J 49/10; H01J 49/165; H01J 49/406; H01J 49/424; H01J 43/246; H01J 43/22; H01J 31/48; H01J 37/244
USPC ..... 250/287, 281, 282, 283, 397, 286, 299, 250/336.1, 207, 292, 339.07, 347, 387, 250/394
See application file for complete search history.

(56) References Cited

U.S. PATENT DOCUMENTS 5,591,969 A 1/1997 Park et al.
5,770,857 A * 6/1998 Fuerstenau ..... H01J 49/165 250/281
6,051,831 A * 4/2000 Koster ..... H01J 49/025 250/281
6,617,768 B1 * 9/2003 Hansen ..... H01J 43/246 313/103 CM
6,756,587 B1 * 6/2004 Bateman ..... H01J 49/0036 250/283
6,864,479 B1 * 3/2005 Davis ..... H01J 49/025 250/283
6,906,318 B2 * 6/2005 Bateman ..... H01J 43/246 250/281
7,291,834 B2 * 11/2007 Gonin ..... H01J 49/40 250/287

(Continued)

OTHER PUBLICATIONS

Park, Melvin A. et al., An Inductive Detector for Time-of-flight Mass Spectrometry, RCMS, 1994, pp. 317-322, John Wiley & Sons, Ltd.

(Continued)

*Primary Examiner* — David A Vanore
(74) *Attorney, Agent, or Firm* — Benoît & CôtéInc.

(57) ABSTRACT

The invention relates to the linear dynamic range of ion abundance measurement devices in mass spectrometers, such as time-of-flight mass spectrometers. The invention solves the problem of ion current peak saturation by producing a second ion measurement signal at an intermediate stage of amplification in a secondary electron multiplier, e.g. a signal generated between the two multichannel plates in chevron arrangement. Because saturation effects are observed only in later stages of amplification, the signal from the intermediate stage of amplification will remain linear even at high ion intensities and will remain outside saturation. In the case of a discrete dynode detector this could encompass, for example, placement of a detection grid between two dynodes near the middle of the amplification chain. The invention uses detection of the image current generated by the passing electrons.

13 Claims, 4 Drawing Sheets

(56) References Cited

U.S. PATENT DOCUMENTS 7,564,043 B2 * 7/2009 Hayashi ..... H01J 49/025 250/287
9,620,351 B2 * 4/2017 Ramsey ..... H01J 49/424
2003/0111597 A1 * 6/2003 Gonin ..... H01J 49/025 250/287
2004/0155187 A1 * 8/2004 Axelsson ..... H01J 49/025 250/336.1
2004/0169137 A1 * 9/2004 Westphall ..... H01J 49/06 250/281
2004/0227070 A1 * 11/2004 Bateman ..... H01J 49/025 250/287
2005/0067932 A1 * 3/2005 Funsten ..... H01J 43/22 313/103 R
2006/0231769 A1 * 10/2006 Stresau ..... G01T 1/28 250/397
2008/0142715 A1 * 6/2008 Yang ..... H01J 49/025 250/336.1
2010/0320372 A1 * 12/2010 Blick ..... H01J 49/025 250/282
2011/0001043 A1 * 1/2011 Wenzel ..... H01J 43/22 250/282
2011/0095174 A1 * 4/2011 Suyama ..... H01J 43/22 250/281
2011/0095178 A1 * 4/2011 Giannakopulos ..... H01J 49/025 250/282
2011/0226943 A1 * 9/2011 Rather ..... H01J 49/0036 250/282
2017/0025265 A1 * 1/2017 Verenchikov ..... H01J 49/025

OTHER PUBLICATIONS

Liu, Ranran et al., Detection of Large Ions in Time-of-Flight Mass Spectrometry: Effects of Ion Mass and Acceleration Voltage on Microchannel Plate Detector Response, J. Am. Soc. Mass Spectrom., May 2, 2014, pp. 1374-1383.

* cited by examiner

HIGH DYNAMIC RANGE ION DETECTOR FOR MASS SPECTROMETERS

BACKGROUND OF THE INVENTION

Field of the Invention

This invention relates to the dynamic range of ion abundance measurement devices in mass spectrometers.

Description of the Related Art

There are in principle two main types of mass spectrometers: In a first type, ions are excited to circulations or oscillations with mass-dependent frequencies in magnetic or electric fields, the frequencies are measured by image currents induced in suitable electrodes, and Fourier transformations are used to transform ion current transients into frequency values which can be scaled to mass values. This first type mainly comprises ion cyclotron resonance mass spectrometers (ICR-MS) and Kingdon mass spectrometers, e.g. the Orbitrap® (Thermo-Fisher Scientific).

In a second type of mass spectrometer, the ions of an ion current from an ion source are directly separated by their masses in time or space, using some kind of "scan"; a measurement of the mass-separated ion current with high temporal resolution results directly in a mass spectrum. Magnetic sector field mass spectrometers, 2D and 3D RF quadrupole ion traps, and time-of-flight mass spectrometers (TOF-MS) belong to this second type of mass spectrometers.

In the following, main attention is directed to this second type of mass spectrometer with direct measurement of the ions separated in time by their masses.

In this second type of mass spectrometer it is usually required to have an ion detector delivering an electric signal the strength of which is linearly proportional to the number of ions detected over a wide range of ion current intensities. This range is called "linear dynamic range". In most cases, ion currents are measured using secondary electron multipliers (SEM), either with discrete dynodes (Allen type SEM), or with a single channel SEM (channeltron), or ion detectors based on microchannel plates (MCP). The ions impinging on the front of the SEM produce a first generation of secondary electrons, usually about three to five electrons per ion, showing a Poisson distribution of the number of electrons generated per ion. The secondary electrons are accelerated inside the SEM and generate an avalanche of secondary electrons, typically ending up in about one million secondary electrons per ion, depending on the voltage adjustment of the SEM. The secondary electron current is detected by a detector electrode (usually called anode). In former times, the detector electrodes were connected to ion pulse counters; in more modern embodiments they are connected to fast analogue amplifiers. The output currents of these fast analogue amplifiers are digitized by fast digitizers. Analogue amplifier and digitizer form a transient recorder, originally developed for special applications of the radar technique.

All these types of secondary electron multiplier have good characteristics for quantitative measurements of the ion current; however, in some applications either the linear dynamic range of the SEM, the linear dynamic range of the amplifier, or the linear dynamic range of the digitizer is insufficient for the analytic task.

Depending on scan speed and mass resolution, the required sampling rate can be moderate, high or even extremely high. The sampling rate is the number of ion current measurements per time unit (usually a second) including amplification and digitization, necessary to nicely resolve the mass peaks. The sampling rate divides the measuring time into small time segments, in which one digital ion current value is produced. Ion traps and magnetic sector field mass spectrometers offer moderate scan speeds in the order of some $10^4$ Daltons per second with moderate mass resolution, requiring sampling rates in the order of 10 megasamples per second (MS/s), resulting in measuring time segments of about 100 nanoseconds. For this scan regime, there are amplifiers and digitizers available with linear dynamic ranges of about $1{:}10^6$ and 18 to 20 bit digitizing width, in general offering a sufficiently large linear dynamic measuring range. In this regime, the SEM usually limits the dynamic measuring range.

In MCP detectors, the channels within the plates are typically tilted by an angle of a few degrees so that the ions, impinging in normal direction onto the MCP, cannot penetrate too deeply into the channels which would produce undefined ion path lengths. MCP detectors typically comprise two microchannel plates where the directions of the channels form a chevron arrangement. In each MCP, the channels are slightly tilted against the direction normal to the plate, and in the chevron arrangement, the tilting angle of the two MCPs is 180° different. The amplification inside an MCP can be adjusted by the voltage across the channels; typically an amplification of 1000 secondary electrons per primary particle is used, achieved by a voltage between 1500 and 2200 volts. In an arrangement of two MCPs, typically about one million secondary electrons are produced per ion during normal operation forming a pulse of less than a nanosecond in length. These secondary electrons from the second MCP constitute the electric "signal" generated by the impinging ions.

As illustrated in FIG. 1 showing the prior art ion detectors, the secondary electrons are typically collected on an anode and the resulting signal is recorded, for example, by a "transient recorder" comprising electric amplifier and digitizer. For moderately fast scanning mass spectrometers, the sampling rate of the transient recorder may amount to 10 megasamples per second; a single sampling time segment then is about 100 nanoseconds long.

Thus, the linear dynamic range of a detector is that range of ion intensities within which the number of electrons produced by the SEM within a sampling time segment is proportional to the number of ions striking the detector within this sampling time segment. Using chevron MCP as secondary electron multiplier, at high ion intensities the number of secondary electrons collected at the anode is no longer proportional to the number of ions striking the detector because the second MCP in the chevron array cannot produce the required current—that is, the first MCP in the detector maintains a gain of 1000 electrons per ion even at high ion intensities, however, the second MCP cannot maintain a gain of 1000 electrons out per (first stage secondary) electron in. For a desired linear dynamic range from 1 primary ion to $10^6$ primary ions, the first MCP has to deliver $10^9$ secondary electrons for $10^6$ ions impinging in the sampling time segment, which still is possible, and the second MCP has to produce $10^{12}$ secondary electrons within the measuring time segment which may no longer be possible.

Other detectors, for example discrete dynode detectors (Allen type SEM), operate in a similar manner as MCP detectors, i.e. with a gain in the form of many secondary electrons out per ion in, but have somewhat different structures.

In contrast to mass spectrometers with moderate scan speed, modern time-of-flight mass spectrometers have scan speeds in the order of $5\times10^7$ Daltons per second with high mass resolution in the order of R=5000 to 100,000 and require sampling rates in the order of 2 to 8 gigasamples per second (GS/s) to maintain the mass resolution of the instrument, resulting in measurement time segments between one half and an eighth of a nanosecond. The total acquisition time for a single spectrum amounts to 100 microseconds only, and about 10,000 single mass spectra can be acquired per second. Usually, several hundred single mass spectra are added to give a sum mass spectrum of high quality. In time-of-flight mass spectrometers, microchannel plates (MCP) are often preferred, because they offer a flat plane resulting in equal flight length for all ions over a small area of about two centimeters in diameter. For this regime of extremely high sampling rates, digitizers with only 8 bit had been available for a long time.

At present, first types of digitizers with 12 bit width and 4 gigasamples per second are available. Here, the amplifying and digitizing devices limit the linear dynamic measuring range for the single mass spectra. The operation of these time-of-flight mass spectrometers requires the safe detection of every single ion, and to add its signal to the sum mass spectrum. Therein, it has to be considered that the sensitivity of the SEM decreases with increasing mass of the ions with about $1/\sqrt{m}$. In order not to miss an ion, amplification of SEM and amplifier are adjusted in such a manner that an ion with a mass of about 500 Dalton results in about 30 counts of the digitizer, resulting in a linear dynamic range of only 1:10 for an 8 bit digitizer, or about 1:100 for a 12 bit digitizer. This is extremely low. If saturation has to be avoided, no more than 100 ions should be allowed to arrive within the corresponding measuring time segment of 0.25 nanoseconds. In spite of the fact that the linear dynamic range increases by the addition of many single mass spectra, quite often ion signals of the single ion mass spectra are found to be in saturation. Adding signals in saturation destroys the linearity of the dynamic measuring range so that quantitation is no longer possible.

In the document US 2011/0226943 A1 (O. Raether: Saturation Correction for Ion Signals in Time-of-Flight Mass Spectrometers; equivalent to DE 10 2010 011 974 A1 and GB 2 478 820 A1) methods are proposed to correct signals in saturation using replacement values calculated on the basis of their signal width; however, this is only a rough approximation. There is still a need for methods and devices to enlarge the linear dynamic range of the ion current measurement regardless of which mechanism limits the range.

In U.S. Pat. No. 6,756,587 B1 (R. H. Bateman et al., "Time-of-Flight Mass Spectrometer and Dual Gain Detector Therefor"), a two-stage MCP detector is described with an intermediate collection electrode, e.g. an electron collecting grid, measuring a part of the current of the electron avalanche at an early state of electron multiplication, and letting through the other part of the electron current to the second MCP detector behind which a final collection electrode receives the secondary electrons. The electron currents captured by the intermediate collection electrode and by the final collection anode are amplified and digitized separately. When the current of the final anode becomes too high for being linearly proportional to the impinging ions, the current of the intermediate electrode is used instead, multiplied with a calibrated amplification factor. This is an elegant method to overcome the problem, applicable regardless whether the saturation is caused by the SEM, by the amplifier, or by the digitizer. Though, it has to be mentioned that, due to the consumptive nature of the intermediate collection electrode, the number of electrons reaching the subsequent multiplication stage is reduced, thereby also affecting the overall multiplication factor manifesting itself at the terminal anode.

In principle, the detection of charged species, like ions and electrons, via image charge induction on a conducting detection element is known from the prior art. In U.S. Pat. No. 5,591,969 (Park et al.) a signal is obtained by a conducting metal grid. Packets of ions passing through the grid were observed to induce a measurable signal related to the number of charges in the ion packet and the speed of the ions. In U.S. Pat. No. 5,770,857 (Fuerstenau et al.) the authors used a conducting metal tube to obtain a similar result. Interestingly, the authors note that " . . . for a point charge passing through a conducting cylinder . . . the image charge will be 95% of the point charge . . . after penetrating . . . slightly less than one diameter of the . . . tube". The implication is that the aspect ratio of passages through a detection element can be of importance in determining the magnitude of the induced image charge and therefore the signal observed from the passage of charged particles. The calculations of Fuerstenau et al. suggest an aspect ratio—i.e. the passage's length divided by its diameter—of two is sufficient to guarantee the maximum induced signal. The work of Park et al. further suggests that an aspect ratio of significantly less than two may be also be adequate depending on what other elements are nearby.

SUMMARY OF THE INVENTION

The present invention increases the linear dynamic range by generating two signals from the avalanche of secondary electrons, produced at two different locations of the avalanche with greatly different amplifications, as known in the state of the art. The invention is characterized by measuring, at least at one location, the image current induced on a grid-like detection element of high transmission by the penetration of the avalanche of secondary electrons. The intermediate acquisition being non-consumptive, as it is based on image currents induced by passing (first stage secondary) electrons, has the advantage that the overall multiplication factor in the detector system remains (largely) unaffected. In a preferred embodiment, image currents are measured at both measurement locations (intermediate and final). Using multichannel plates (MCP), the first image current measurement may take place after a first amplification of the electron current by one or two MCPs, and the second image current measurement after amplification by a further MCP. Because saturation effects are observed only in later stages of amplification, the signal from the intermediate stage of amplification will remain linear even at high ion current intensities and will remain outside saturation. In the case of a discrete dynode detector this could encompass, for example, placement of an image current detection element between two dynodes near the middle of the amplification chain.

The ion detector system according to principles of the present disclosure is particularly suitable for use in mass spectrometers, in particular time-of-flight mass spectrometers.

The grid-like detection element used for the image current measurements preferably has a high transmission factor, favorably in the order of 90 percent or higher. The grid may be made from thin wires. Alternatively, a preferred version of the detection element consists of a thin conducting plate having a high open area ratio—the open area consisting of holes having high aspect ratios. The high open area ratio allows for high electron transmission efficiency, preferably 90% or greater. The aspect ratio of the holes—the depth of the holes divided by their diameter—is preferably such that at some point during the transit of electrons through the detection element, near 100% of the field lines of the electrons terminate on the detection element, thus, generating the maximum possible image current. In one preferred embodiment, the aspect ratio is approximately one—i.e. the thickness of the detection element is about the same as the diameter of the holes there-through. In a specially preferred embodiment such a high open area ratio, high aspect ratio detection element takes the form of a hexagonal array of holes with hexagonal form in a conducting plate. The hexagonal array may be produced by chemical or laser etching from a metal sheet, or by 3D printing.

DETAILED DESCRIPTION

While the invention has been shown and described with reference to a number of different embodiments thereof, it will be recognized by those of skill in the art that various changes in form and detail may be made herein without departing from the scope of the invention as defined by the appended claims.

Figure 1:
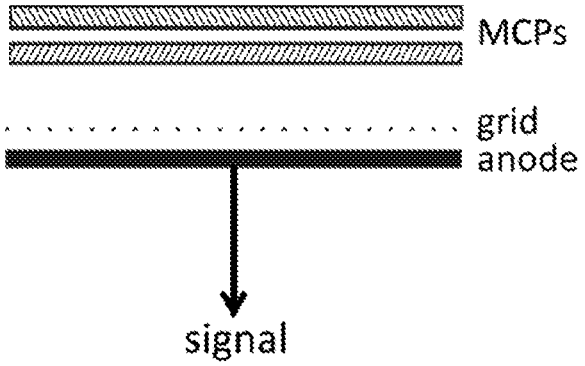
FIGURE 1 (PRIOR ART)
FIG. 1 presents a state-of-the-art MCP ion detector using two microchannel plates (MCP) in chevron arrangement. Under normal operation conditions, each of the two microchannel plates will amplify by a factor of about 1000, resulting in a total amplification of $10^6$, i.e. a million secondary electrons will be emitted for each ion impinging the plates. If more than $10^4$ ions arrive within the digitizing period of about a quarter of a nanosecond, the second MCP can no longer deliver the more than $10^{10}$ secondary electrons required for a signal which is proportional to the ion current. The linear dynamic range thus is restricted to a maximum of about $1{:}10^4$. If the MCPs are adjusted in such a manner that one ion yields about 30 counts of the digitizer, the linear dynamic range is reduced to 1:300 only. With a 8 bit digitizer, the linear dynamic range is further reduced to 1:8 only; even using a most modern digitizer with 12 bit, the linear dynamic range is still reduced to about 1:100. The grid with high transmission in front of the anode serves (in a known way) to screen the anode from induced image currents by the incoming electron pulse which would lead to the deterioration of the shape of short ion pulses.
Figure 2:
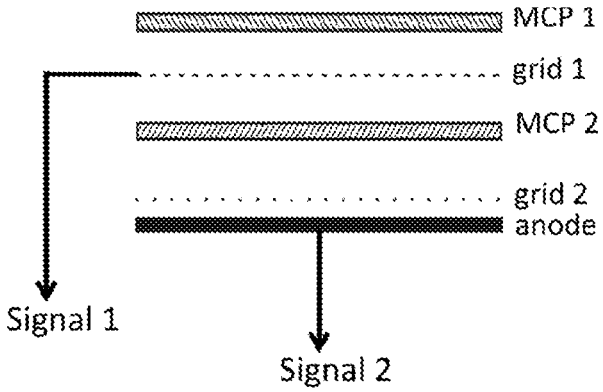
FIGURE 2 (PRIOR ART)
FIG. 2 illustrates an improvement of the linear dynamic range known in the state of the art. In addition to the high transmission screening grid 2 in front of the anode, a grid 1 is installed with about 50% transmission between the two microchannel plates MCP 1 and MCP 2. About 50% of the electrons from the first MCP fall on the grid and produce "signal 1" while the remaining 50% of electrons impinge on MCP 2 for further amplification. The electrons from MCP 2 are collected by the anode and produce "signal 2". Under preferred operation conditions, signal 2 would be about 1000 times higher than signal 1. But whereas signal 2 is exposed to saturation, signal 1 remains linearly proportional to the incoming ion current. The separate amplification and digitization of signals 1 and 2 allows for the generation of a combined signal with high linear dynamic range.
Figure 3:
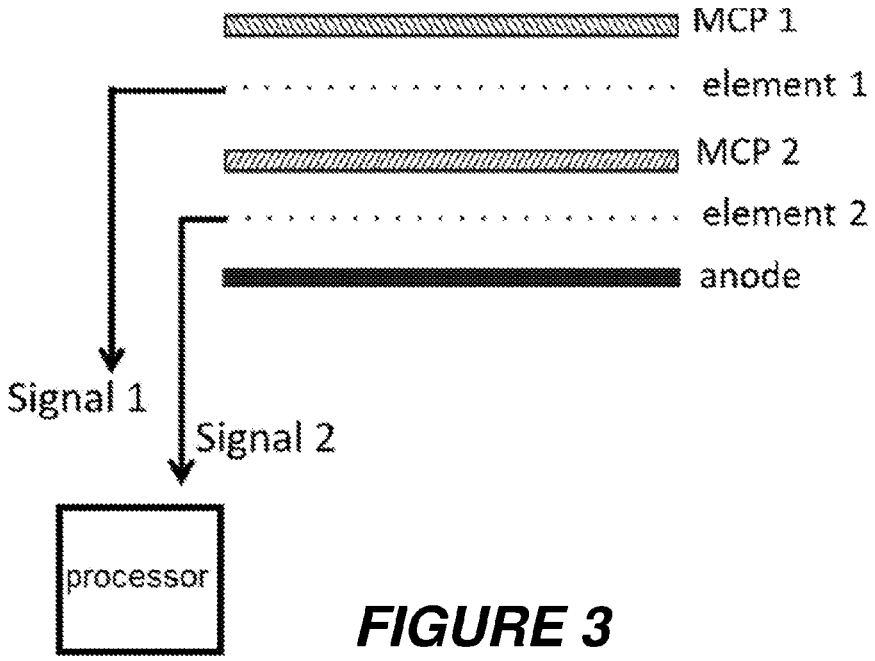
FIG. 3 depicts an embodiment in accordance with principles of the present invention. The electron avalanches after MCP 1 and MCP 2 induce image currents of greatly different strength in the two high transmission grid-like detection elements 1 and 2, the image currents of which are amplified and used for the generation of a combined signal with high linear dynamic range.

In FIG. 3, two grid-like detection elements are placed before and after the second MCP 2 of an arrangement that would normally be used in an MCP detector. The detection elements may, for example, be configured for 90% transmission so that 90% of the electrons from the first MCP pass through detection element 1 and strike MCP 2 for further amplification. The electrons produce in detection element 1 an image current called "signal 1". Electrons from MCP 2 pass through detection element 2 and produce an image current called "signal 2". (See, for instance, M. A. Park and J. H. Callahan, Rapid Com. Mass Spectrom. 8 (4), 317, 1994). The passing electrons are neutralized at the anode. Signals 1 and 2 may be recorded independently—i.e., in separate channels of a digitizer—and then recombined in-silico or in a processor to produce a spectrum of higher dynamic range. The measurement of the image current for both signal 1 and signal 2 via substantially identical detection elements has the advantage, that both image currents have the same profile in time.

If an array of thin wires is used as the detection element, there is a danger that the signal could be somewhat distorted by electrons impinging on the wires. If the electrons are absorbed, there is an additional electron current, but if the impingement causes secondary electrons to leave the wire, the image current is reduced by this current of leaving electrons. It is, therefore, advantageous to reduce the formation of secondary electrons at the wires of the grid by methods known to those of skill in the art. For example, one may make the wires of the detection element from conductors known to have a high work function—e.g. platinum—or known to form thin oxide layers known to have high work functions—e.g. tungsten oxide. Higher work functions will lead to lower rates of electron emission. Ideally, absorbed electrons and generated secondary electrons should be in balance.

In an alternate embodiment, the current generated in the anode by the impinging electrons can be measured instead of the image current of detection element 2, and then compared and/or combined with signal 1 in a processor, for instance.

Figure 4:
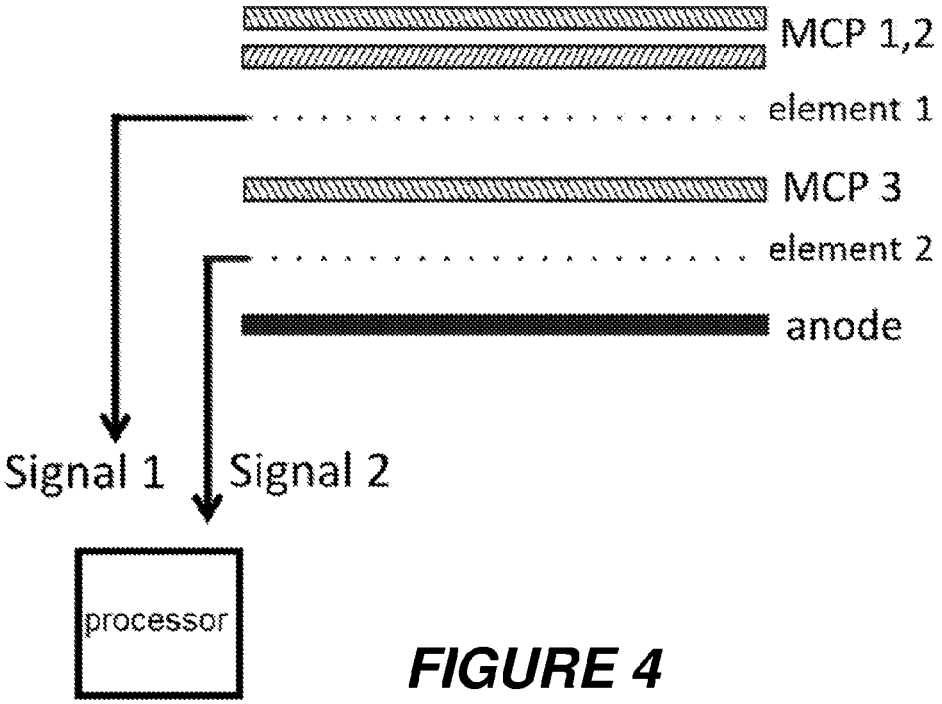
In FIG. 4, three multichannel plates are used to generate the secondary electron avalanche, and the two high-transmission grid-like detection elements are placed between MCP 2 and MCP 3, thus generating image current signals in a different relation.

Still other embodiments may comprise double MCPs instead of a single MCP, as shown in the example of FIG. 4. In this case, the $MCP_{1,2}$ should be operated by a lower voltage to avoid early saturation, but this arrangement allows the option of a higher gain before further amplification by MCP 3.

Figure 5:
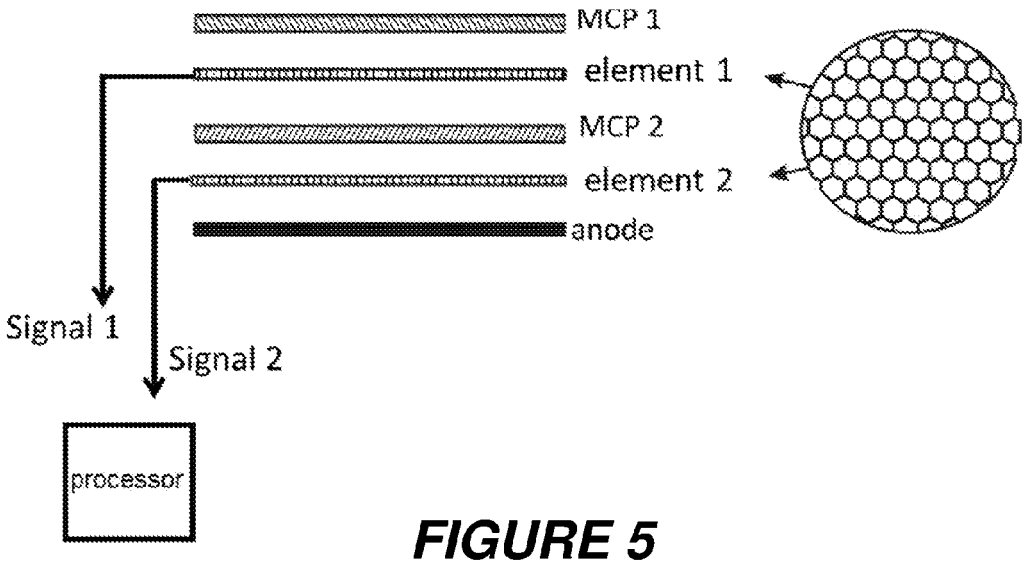
FIG. 5 shows the use of hexagonal array detection elements instead of wire grids to optimize the induction of image currents.

The generation of image currents may be optimized by using detection elements with holes having high aspect ratios, as shown by way of example in FIG. 5. The aspect ratio may be defined as the depth of the holes divided by their diameter. According to the embodiment of FIG. 5, the detection element encompasses a thin conducting plate having a high open area ratio—the open area consisting of holes having high aspect ratios. The high open area ratio allows for high electron transmission efficiency, preferably 90% or greater. The aspect ratio of the holes—the depth of the holes divided by their diameter—is preferably such that at some point during the transit of electrons through the detection element, near 100% of the field lines of the electrons terminate on the detection element, thus, guaranteeing the maximum possible image current. It should be noted, however, that an excessively high aspect ratio will result in a non-Gaussian, "flat top" signal of the image current. Thus, there is a preferred aspect ratio whereby the maximum induced signal occurs when, and only when, the electron is exactly half way through the detection element.

In one preferred embodiment, the aspect ratio is approximately one—i.e. the thickness of the detection element is about the same as the diameter of the holes there-through, generating a short image current pulse of nearly maximum strength. In the embodiment of FIG. 5 such a high open area ratio, high aspect ratio detection element takes the form of a hexagonal array of holes in a conducting plate. Such detection elements may be produced from metal sheets by chemical etching, or by laser etching. A further method is 3D-printing from metal powder, e.g. Titanium powder. This method is known in the aircraft industry.

Figure 6:
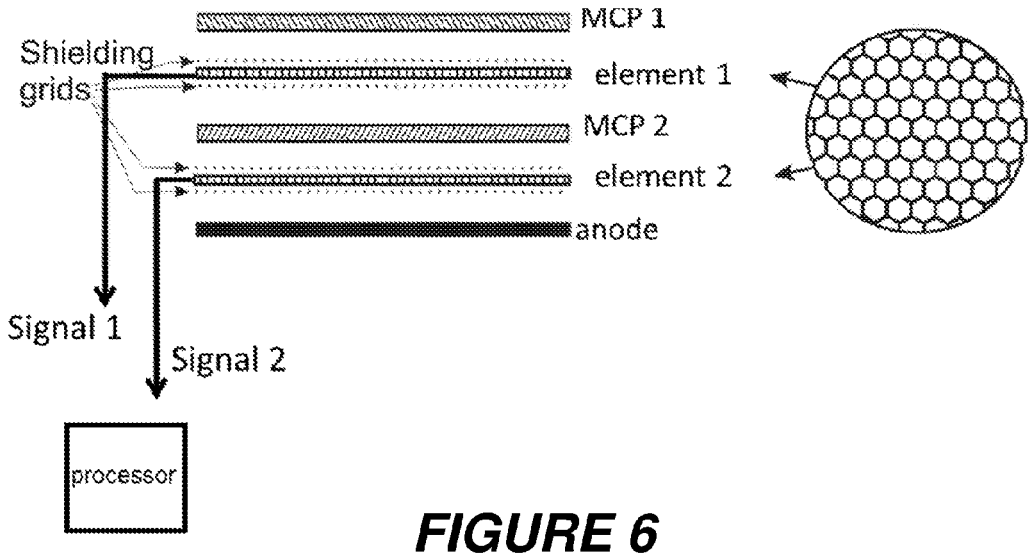
FIG. 6 depicts shielding grids before and after the hexagonal array detection elements to sharpen the image current signals.

The detection elements may be enclosed by high transmission grids to shield them from incoming and departing electrons and thereby avoiding long leading and trailing edges in the signals. This embodiment is presented in FIG. 6.

Figure 7A:
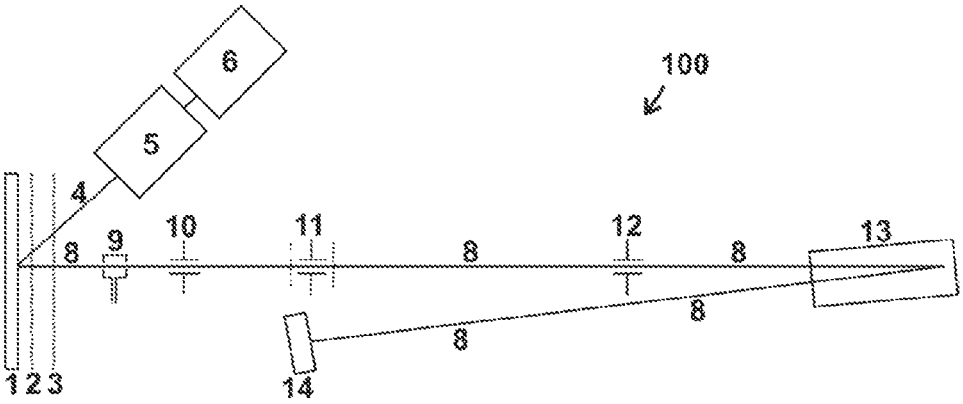
FIGS. 7A-B illustrate schematically time-of-flight mass spectrometers that may be equipped with ion detector systems according to principles of the present disclosure.

FIG. 7A shows a MALDI time-of-flight mass spectrometer 100 that includes a pulse laser 6. Samples are located on a sample support plate 1 opposite accelerating electrodes 2 and 3, and can be ionized by a beam of laser light pulses 4. The laser unit 6 supplies the laser light pulses whose profiles are shaped favorably and as required by beam shaping device 5. The resultant ions are accelerated by the accelerating electrodes 2 and 3 to create an ion beam 8, which passes through a gas cell 9 which may be filled with collision gas, if required, a parent ion selector 10, a daughter ion post-acceleration unit 11 and a parent ion suppressor 12, and is then reflected from the reflector 13 onto the ion detector 14 which may be embodied as an ion detector system according to principles of the present disclosure.

Figure 7B:
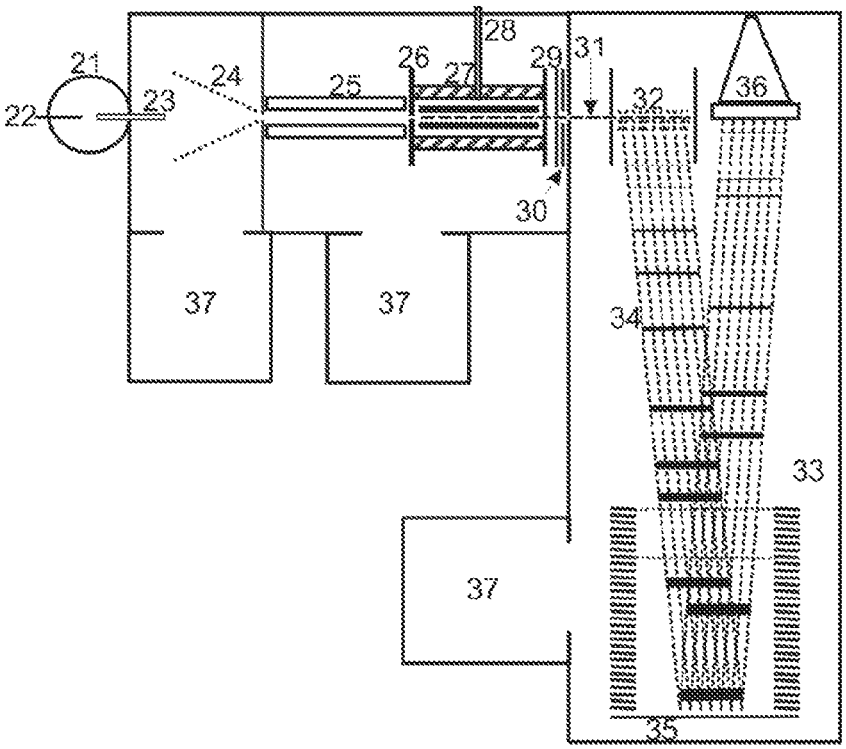

The ion detector system according to principles of the present disclosure may also be part of a mass spectrometer like that shown in FIG. 7B. Ions are generated at atmospheric pressure in an ion source 21 with a spray capillary 22, and these ions are introduced into the vacuum system through a capillary 23. A conventional RF ion funnel 24 guides the ions into a first RF quadrupole rod system 25, which can be operated both as a simple ion guide and also as a mass filter for selecting a species of parent ion to be fragmented. The unselected or selected ions are fed continuously through the ring diaphragm 26 and into the storage device 27; selected parent ions can be fragmented in this process by energetic collisions. The storage device 27 has an almost gastight casing and is charged with collision gas through the gas feeder 28 in order to focus the ions by means of collisions and to collect them in the axis. Ions are extracted from the storage device 27 through the switchable extraction lens 29. This lens, together with the einzel lens 30, shapes the ions into a fine primary beam 31 and sends them to the ion pulser 32. The ion pulser 32 periodically pulses out a section of the primary ion beam 31 orthogonally into the high-potential drift region 33, which is the mass-dispersive region of the time-of-flight mass spectrometer, thus generating the new ion beam 34 each time. The ion beam 34 is reflected in the reflector 35 with second-order energy focusing, and is measured in the ion detector system 36 that may operate according to principles of the present disclosure. The mass spectrometer is evacuated by the pumps 37. The reflector 35 represents a two-stage Mamyrin reflector in the example shown featuring a first strong deceleration field, followed by a weaker reflection field.

The invention concerns an ion detector system for mass spectrometers, based on a secondary electron multiplier having at least two consecutive multiplication stages that produce an avalanche of secondary electrons being used to generate a final signal at the end of the multiplication stages. The detector system has a grid-like detection element installed between the multiplication stages which generates an intermediate signal at an intermediate amplification, wherein at least the intermediate signal is based on an image current induced in the grid-like detection element.

The detector system may further comprise a second grid-like detection element at the end of the multiplication stages to generate the final signal based on image currents induced in the second grid-like detection element (just like the intermediate signal). The detection elements can be conducting plates with holes having high open area ratio. In preferred embodiments, an aspect ratio of the holes, i.e. depth divided by diameter, is approximately unity (optimized for maximum image current and short image current pulses). In some embodiments, the holes can form a hexagonal array. It is possible to enclose the detection elements on two sides by high transmission shielding grids.

The detector system may further comprise a processor that uses the final signal to calculate a value proportional to an impinging ion current when the final signal is not in saturation and uses the intermediate signal to calculate a value proportional to the impinging ion current when the final signal is in saturation. In an alternative embodiment, the processor could use scaled data from the intermediate signal to replace saturated data from the final signal and could calculate a value proportional to an impinging ion current from the final signal thusly corrected.

In preferred embodiments, the grid-like detection element may be a high transmission wire grid. Preferably, the wire grid has a transmission higher than 90 percent, and the intermediate signal can be based on the image current at this wire grid.

The detector system may further comprise amplifiers and digitizers for both the final signal and the intermediate signal.

The invention has been shown and described above with reference to a number of different embodiments thereof. It will be understood, however, by a person skilled in the art that various aspects or details of the invention may be changed, or various aspects or details of different embodiments may be arbitrarily combined, if practicable, without departing from the scope of the invention. Generally, the foregoing description is for the purpose of illustration only, and not for the purpose of limiting the invention which is defined solely by the appended claims, including any equivalent implementations, as the case may be.

The invention claimed is:

1. An ion detector system for mass spectrometers, comprising a secondary electron multiplier having at least two consecutive multiplication stages that produce an avalanche of secondary electrons being used to generate a final signal at the end of the multiplication stages, the ion detector system further comprising a grid-like detection element which is installed between the multiplication stages and in which an image current is induced, the image current being used to generate an intermediate signal at intermediate amplification.

2. The ion detector system according to claim 1, further comprising a second grid-like detection element at the end of the multiplication stages to generate the final signal based on an image current induced in the second grid-like detection element.

3. The ion detector system according to claim 2, wherein the detection elements are conducting plates with holes having an open area ratio which allows an electron transmission efficiency of 90% or greater.

4. The ion detector system according to claim 3, wherein an aspect ratio of the holes, i.e. depth divided by diameter, is approximately unity.

5. The ion detector system according to claim 3, wherein the holes form a hexagonal array.

6. The ion detector system according to claim 3, wherein the detection elements are enclosed on two sides by shielding grids.

7. The ion detector system according to claim 1, further comprising a processor that receives the final signal and the intermediate signal and calculates a value proportional to an impinging ion current, the processor calculating said value from the final signal when the final signal is not in saturation, and calculating said value from the intermediate signal when the final signal is in saturation.

8. The ion detector system according to claim 1, further comprising a processor that receives the final signal and the intermediate signal, uses scaled data from the intermediate signal to replace saturated data from the final signal and calculates a value proportional to an impinging ion current from the final signal thusly corrected.

9. The ion detector system according to claim 1, wherein the grid-like detection element is a wire grid having a transmission higher than 90 percent.

10. The ion detector system according to claim 9, wherein the intermediate signal is based on the image current at this wire grid.

11. The ion detector system according to claim 1, further comprising amplifiers and digitizers for both the final signal and the intermediate signal.

12. A time-of-flight mass spectrometer having an ion detector system for mass spectrometers, the ion detector system comprising a secondary electron multiplier having at least two consecutive multiplication stages that produce an avalanche of secondary electrons being used to generate a final signal at the end of the multiplication stages, wherein the ion detector system further comprises a grid-like detection element which is installed between the multiplication stages and in which an image current is induced, the image current being used to generate an intermediate signal at intermediate amplification.

13. The ion detector of claim 1, wherein the detection element has holes an aspect ratio of which, i.e., depth divided by diameter, is approximately unity.

* * * * *